US006814278B2

(12) United States Patent
Gerrie et al.

(10) Patent No.: US 6,814,278 B2
(45) Date of Patent: Nov. 9, 2004

(54) COMBINED INTEGRAL PICTURE FRAME AND MAILER

(75) Inventors: William Gerrie, Webster, NY (US); Louis Thyroff, Pittsford, NY (US)

(73) Assignee: Omnifile, Inc., Rochester, NY (US)

( * ) Notice: Subject to any disclaimer, the term of this patent is extended or adjusted under 35 U.S.C. 154(b) by 148 days.

(21) Appl. No.: 09/766,745

(22) Filed: Jan. 22, 2001

(65) Prior Publication Data

US 2002/0095914 A1 Jul. 25, 2002

(51) Int. Cl.[7] ..... B65D 27/00
(52) U.S. Cl. ..... 229/67.1; 229/305
(58) Field of Search ..... 53/460; 229/92.8, 229/92.7, 92.3, 71; 40/774, 775, 776, 788, 789; 206/232

(56) References Cited

U.S. PATENT DOCUMENTS

| | | | | | |
|---|---|---|---|---|---|
| 3,711,012 | A | | 1/1973 | Cytron et al. | |
| 3,762,630 | A | | 10/1973 | Braznell | |
| 3,827,170 | A | | 8/1974 | Lau | |
| 4,167,241 | A | * | 9/1979 | Zumbrunn | 229/92.8 |
| 4,244,511 | A | | 1/1981 | Coleman | |
| 4,479,318 | A | | 10/1984 | Russell | |
| 4,763,789 | A | | 8/1988 | Questel et al. | |
| 4,980,982 | A | | 1/1991 | Verdon et al. | |
| 5,154,392 | A | | 10/1992 | Voight | |
| 5,201,464 | A | | 4/1993 | File | |
| 5,232,087 | A | | 8/1993 | Schluger | |
| 5,253,798 | A | | 10/1993 | Lombardo | |
| 5,261,174 | A | | 11/1993 | Blegen | |
| 5,303,489 | A | | 4/1994 | Blegen | |
| 5,314,110 | A | | 5/1994 | Lombardo | |
| 5,333,728 | A | * | 8/1994 | O'Brien et al. | 206/232 |
| 5,361,521 | A | * | 11/1994 | Burtch | 40/750 |
| 5,439,101 | A | | 8/1995 | Brink et al. | |
| 5,575,384 | A | | 11/1996 | Saye | |
| 5,641,115 | A | | 6/1997 | Brewster | |
| 5,678,756 | A | * | 10/1997 | Sugiura | 229/313 |
| 5,740,957 | A | * | 4/1998 | Wenkman | 229/92.8 |
| 5,782,452 | A | | 7/1998 | Bosworth | |
| 5,788,144 | A | | 8/1998 | Sorge et al. | |
| 5,950,341 | A | * | 9/1999 | Cross | 40/750 |
| 6,016,907 | A | * | 1/2000 | Dreier | 206/232 |

* cited by examiner

*Primary Examiner*—Eugene Kim
*Assistant Examiner*—John Paradiso
(74) *Attorney, Agent, or Firm*—Brian B. Shaw, Esq.; Roger Aceto, Esq.; Harter, Secret & Emery LLP

(57) ABSTRACT

An integral frame and mailer formed from a single blank is disclosed. The blank includes a frame having a frame front panel and a frame rear panel, the frame rear panel being connected to a mailer rear panel along a fold line. A mailer front panel is foldably connected to the mailer front panel, wherein the mailer front panel and mailer rear panel effectively sandwich the frame front panel and frame rear panel therebetween.

4 Claims, 4 Drawing Sheets

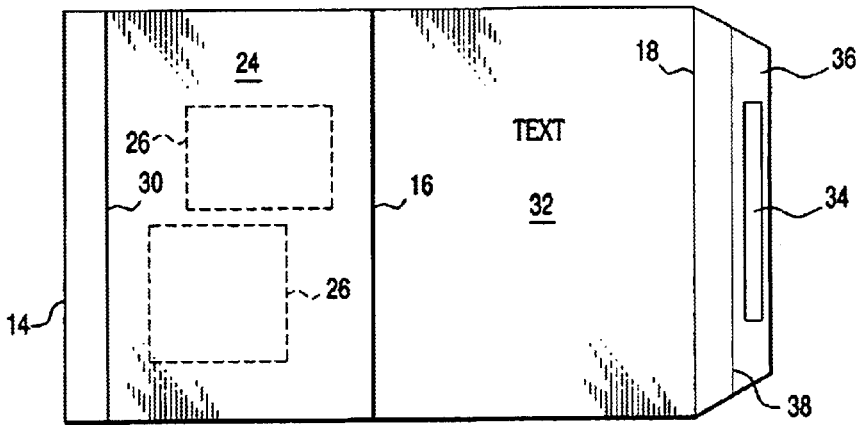
FIG.3
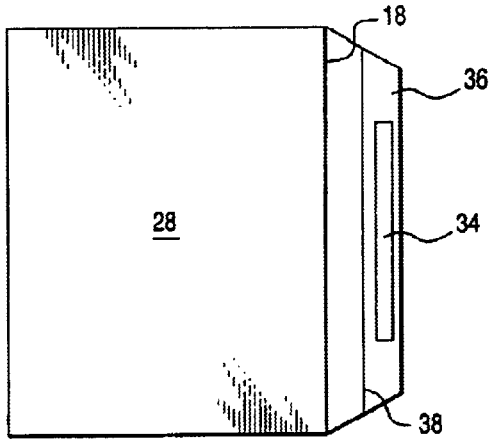
FIG.4
FIG.5
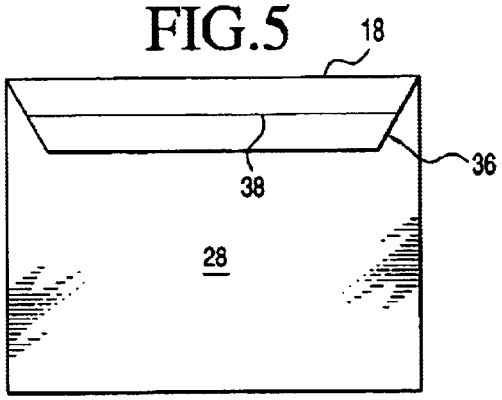
FIG.6
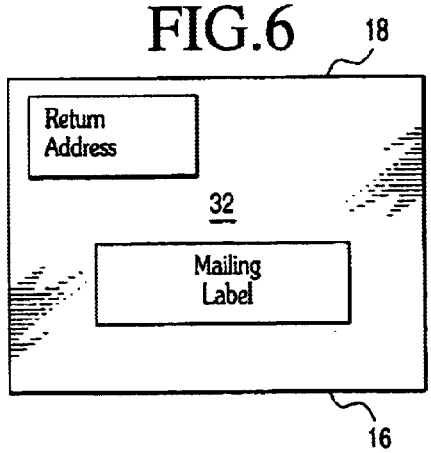

COMBINED INTEGRAL PICTURE FRAME AND MAILER

FIELD OF THE INVENTION

The invention is related to mailers and picture frames, and more specifically, to a combined mailer and picture frame, which can withstand shipping and mailing and provide a separable frame having an aesthetically pleasing appearance.

BACKGROUND OF THE INVENTION

People often want to send photographs through the mail, whether it be to family members, friends, or others. However, there are problems with sending photographs through the mail.

Most envelopes are too soft to be used to protect photographs during transit. Unlike letters, a photograph cannot be creased or bent without permanent damage to the photograph.

Alternatively, one may frame the picture before mailing it. While the frame will protect the picture during mailing, it will greatly increase the cost of mailing the photograph.

To alleviate this problem, special envelopes have been developed for mailing pictures such as that disclosed in U.S. Pat. No. 5,740,957 issued Apr. 21, 1998. However, one problem with the frame and mailer disclosed therein is that the easels are exposed during the shipping process. It is possible that they would catch on some other item in the mail and rip or tear away. This could not only cause problems for the end receiver, but could cause problems for the U.S. Post Office. If the easels were to be pulled into an extended position during shipping, the mailer may jam the sorting machinery that the post office uses.

Therefore, a need exists for a combined picture frame and mailer that can withstand the postal process, and provide an attractive separable frame. The need also exists for a combined picture frame and mailer that reduces complications in the mailing process. It is also desirable to produce a combined picture frame and mailer that is easier to manufacture than current combined picture frame and envelopes.

SUMMARY OF THE INVENTION

Generally, the invention provides to a combined frame and mailer. The invention allows a person to insert a photograph or picture into a frame, wherein an integral mailer can be folded and sealed about the frame to preclude unintended separation of the photograph from the frame. The sealed product is then mailed, wherein the recipient can subsequently separate the frame from the mailer without altering a pre-existing frame border.

A preferred embodiment of the present invention includes a blank divided into a series of panels. A first panel forms a frame front. The frame front has a viewing aperture through which a photograph is viewed. A second panel forms a frame rear and is connected to the frame front along a first fold line. The frame rear can include easels that may be folded outward from the panel. The easels allow the frame to be stood upright when the frame is detached from the mailer. To form the frame, the frame front is folded onto the frame rear and sealed together to form a frame having a picture receiving pocket. Pictures may be inserted through the open edge of the frame.

A third panel forming a mailer rear panel is connected to the frame rear along a second fold line. A fourth panel forming a mailer front panel is foldably connected to the mailer rear panel along a third fold line. A closure flap is foldably connected to the fourth panel along a closure fold line. The closure flap can include an adhesive.

The frame may be folded over to overlay the mailer rear panel. The frame and mailer rear panel may then be folded to overlay the frame rear panel and the mailer front panel, thereby protecting both the front and the rear of the frame.

The blank includes a separation line intermediate the first fold line and the second fold line to be proximal to the second fold line and located so that the mailer can be detached from the frame along the separation line. The separation line is located within the footprint of the periphery of the frame front.

The embodiments of the invention disclosed below not only protect the photograph; they also protect the easels cut into the frame rear. The projected markets for these combined picture frame and envelopes include retail sales to tourists and special order sales to businesses. The tourist consumer could write greeting information on the inside. The corporate client could include promotional information to clients, employees, or others.

BRIEF DESCRIPTION OF THE DRAWINGS

FIG. 3 is a top plan view showing partial enclosure of the frame in the mailer;

FIG. 4 is a top plan view showing an unsealed folded mailer;

FIG. 5 is a top plan view of a folded and sealed mailer;

FIG. 6 is a bottom plan view of a folded and sealed mailer.

DETAILED DESCRIPTION OF THE PREFERRED EMBODIMENT

Figure 1:
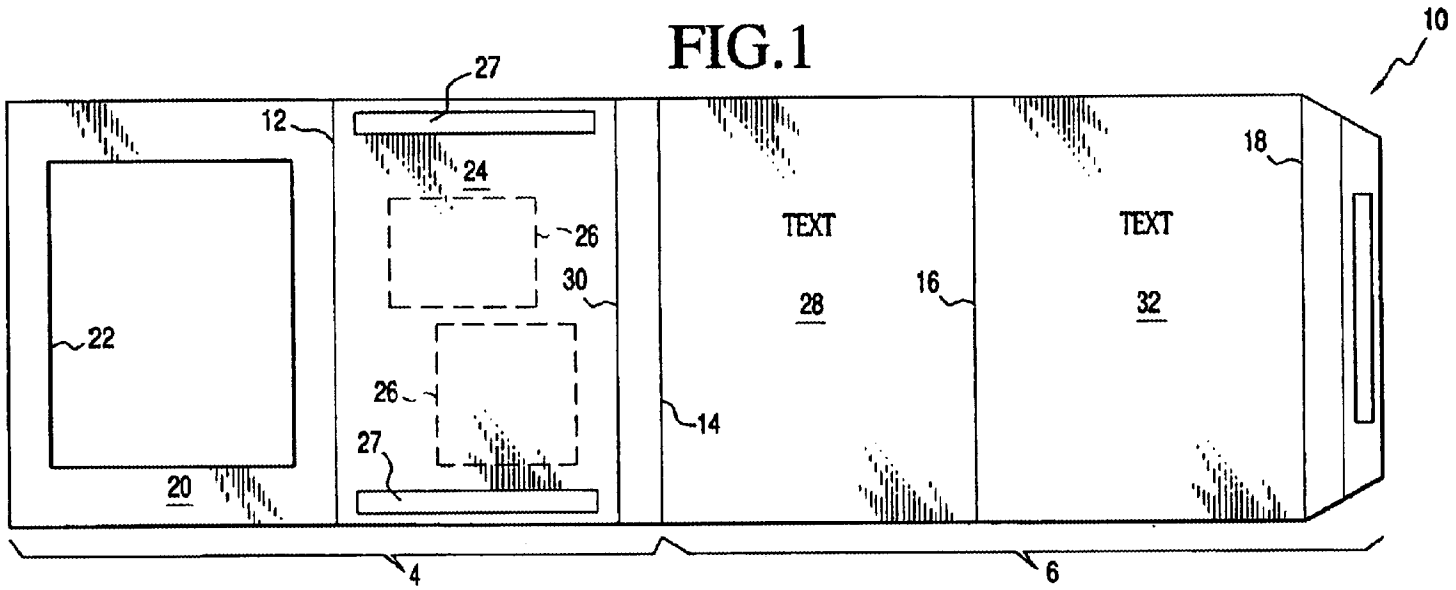
FIG. 1 is a top plan view of a blank for making the present invention.

Referring to FIG. 1, a combined picture frame 4 and mailer 6 is formed from a blank 10. The blank 10 includes a first panel 20, a first fold line 12, a second panel 24, a separation line 30, a second fold line 14, a third panel 28, a third fold line 16, a fourth panel 32, a closure fold line 18 and a closure flap 36. The blank 10 can be formed of a variety of materials including, but not limited to paper board, press board, board, composite, laminates, plastic, or corrugated cardboard.

The fold lines 12, 14, 16 and 18 are located so that the panels can assume an overlapping coplanar configuration. The term fold line refers to lines or creases that allow adjacent panels to fold or bend about an axis lying on the fold line. In a preferred embodiment, the blank 10 is creased so that the fold lines all bend in the same direction.

Figure 2:
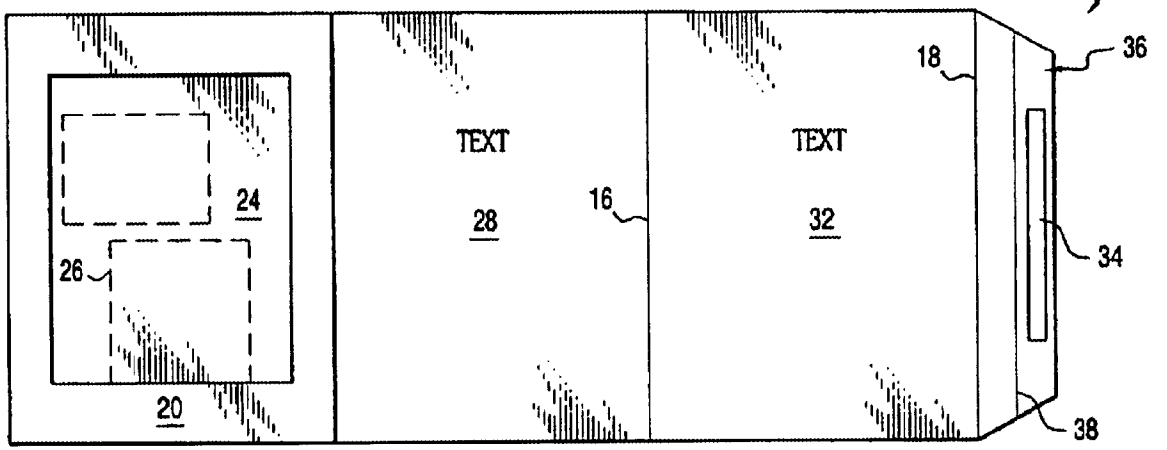
FIG. 2 is a top plan view of the blank showing the formation of the frame.

As shown in FIG. 1, a first surface, or side of the blank 10 is shown. Thus, a second surface, or side of the blank 10 is not visible in FIG. 1. Referring to FIG. 2, the second side of the first panel 20 is visible as well as the first side of the third and fourth panels and a portion of the second panel.

The first panel 20 forms the front of the frame and is referred to as frame front panel. An aperture 22 is cut from the frame front panel 20. The aperture 22 provides a window for viewing a photograph placed within the frame 4. A clear plastic or film pane may be placed over the aperture 22, however, the frame 4 can be employed without the pane. The aperture 22 could be any of a variety of shapes. Examples of other shapes include ovals, circles, ellipses and heart-shaped apertures. It is understood the second side of the frame front panel 20 can include a surface finish such as printing, stamping or foil. As described herein, the second side of the frame front panel 20 will form the visible portion of the frame surrounding the retained picture. Thus, an aesthetically pleasing finish can be provided.

The second panel 24 forms the rear of the frame and is referred to as the frame rear panel. The frame rear panel 24 is connected to the frame front panel 20 along the first fold line 12. The frame rear panel 24 includes easel forming cuts 26 and corresponding access apertures. The frame rear panel 24 thus provides for easels to orient the frame in an upright free-standing position.

The frame 4 is formed by folding the frame front panel 20 along the first fold line 12 to overlay the frame rear panel 24. The frame front and frame rear are bonded to each other along seal lines or patches 27. The patches 27 may be formed on the blank 10 to include a removable strip covering an adhesive. The strip can be selectively removed to form the frame. Alternatively, the patch 27 is formed of an adhesive, which is promptly contacted with the remaining panel of the frame 4. Preferably, adhesive strips 27 are located along an upper and lower area of the frame rear panel 24. It is understood these strips may be placed along the upper and lower portions of the frame front panel. Preferably, the strips are applied during the manufacturing process to be parallel to top and bottom edges of the panel. Any particular type of glue or sealant may be used. The sealing strips 27 along the two edges combined with the fold line 12 leaves an opening along an edge between the first and second panels 20, 24 respectively opposite the fold line 12. A picture (not shown) may be inserted through the opening after the panels 20 and 24 are bonded together.

Although the periphery of the front frame panel 20 and the rear frame panel 24 are shown as rectangular, the peripheries can have a variety of configurations. For example, the frame front panel 20 could have an oval shape except where part of one side would be flattened out so that it could be creased and folded over onto the frame rear panel 24. Preferably, each panel has a straight edge along the first fold line 12.

The frame rear panel 24 includes a separation line 30 intermediate the first fold line 12 and the second fold line 14, and located proximal to the second fold line. Upon the front frame panel 20 overlaying the rear frame panel 24, the separation line 30 is within the periphery of the front frame panel. The separation line 30 provides a line of weakness in the blank 10, which is weaker than the fold lines. The separation line 30 can be a perforation line where the blank 10 is sufficiently weakened to allow the material to separate easily. The separation line 30 allows the frame 4, including frame front panel and frame rear panel (20,24) to be detached from the mailer 4 (panels 28, 32) after the blank 10 has been folded into a mailable configuration. Upon forming the frame 4, the separation line 30 is located within the footprint of the periphery of the frame front panel 20, so that an edge formed by the separation line 30 is not visible to a viewer of a picture in the frame 4. The separation line 30 does not have to be perforated, but may be any line where the material has been weakened to allow separation of the panels along the separation line 30 prior to any separation along a fold line.

The third panel 28 forms a mailer rear panel and is foldably connected to the frame rear panel 24 along the second fold line 14. Preferably, the mailer rear panel 28 is a contiguous uninterrupted panel. That is, the mailer rear panel 28 is free of cuts, perforations or apertures. The fourth panel 32 is a mailer front panel and is connected to the mailer rear panel 28 along the third fold line 16. The first side of both the mailer panels 28, 32 can contain areas for writing or pasting a message or other information. The second side of the front mailer can include a mailing label as seen in FIG. 6.

The closure flap 36 is connected to the mailer front panel 32 along closure fold line 18. An adhesive strip or seal 34 is formed on the closure flap 36 so that the flap will bond to the second side of the mailer rear panel 28 when the mailer is prepared for mailing. The preferred embodiment includes a peel and seal type strip.

The closure flap 36 further includes a zip strip 38 is located between closure fold line 18 and the adhesive strip 34. The zip strip allows the mailer 6 to be unfolded without damaging the retained photograph. Alternatively, the closure flap 36 can include a tear strip, tear line or tear lines for breaking the closure flap. That is, the closure flap 36 is sacrificed to open the sealed mailer.

Figure 7:
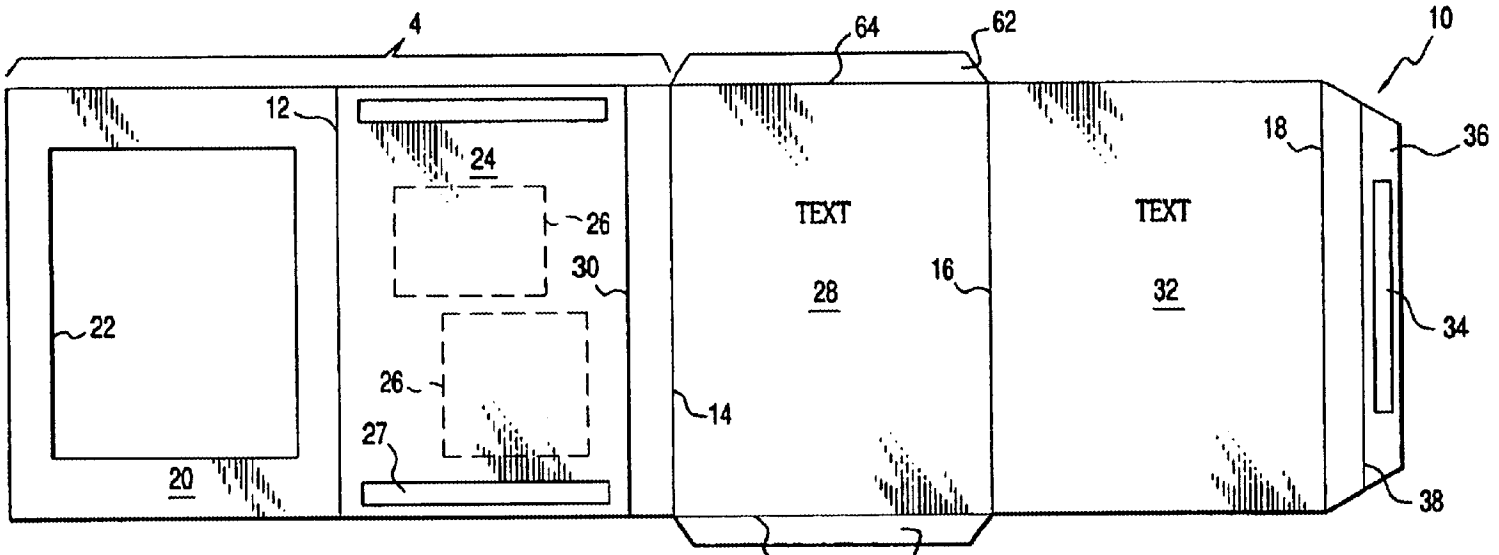
FIG. 7 is a top plan view of an alternative blank having retaining flaps for making the present invention.
Figure 8:
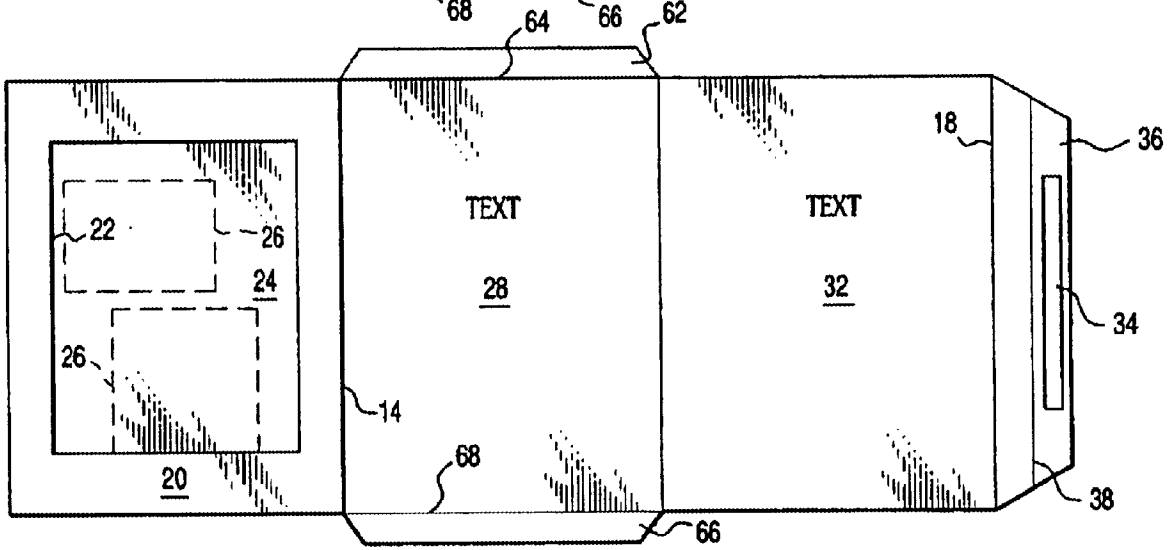
FIG. 8 is a top plan view of the blank of FIG. 7, showing formation of the frame.

Referring to FIGS. 7–11, the blank 10 can be formed to provide retaining flaps 62, 66. The retaining flaps are preferably integrally formed with the blank 10. The retaining flap 62 is foldably connected to the top edge, as seen in FIG. 7, of the mailer rear panel 28 along fold line 64. The retaining flap 66 is foldably connected to the bottom edge, as seen in FIG. 7, of the mailer rear panel 28 along fold line 66. The fold lines 64 and 66 are formed in the same manner as fold lines 12, 14, 16 and 18. That is, each fold line has a preferred direction of folding. Specifically, referring to FIG. 7 each of the fold lines 12, 14, 16, 18, 64 and 66 prefer folding of either adjacent panel in an upward, out of the plane of the page, direction.

Although the retaining flaps 62, 66 can have any of a variety of configurations and sizes, the flaps are preferably sized to overlay a sufficient area of the frame rear panel 24 to substantially preclude the flap from unfolding upon operable assembly of the mailer.

Preferably, the retaining flaps do not include an adhesive.

Manufacture

Printing, foil stamping, die-cut shapes and embossing can be provided on either side of the panels. In a preferred embodiment the second side of the frame front panel 20 is foil-stamped.

The blank 10 is cut from a sheet of desired material. One method of accomplishing this is by die-cutting. The aperture 22 is also created in the first panel 20. Preferably these methods leave relatively smooth borders that are aesthetically pleasing to the eye. That is, the edges are free of scallops or shards. In addition, the easel cuts and associated apertures can be similarly formed in the frame rear panel 24.

After the blank 10 is completely cut, it may be folded and glued in a single one pass through an assembly line. That is, each of the manufacturing processes are applied to a single side of the blank 10. Thus, the blank 10 can be converted to the configuration of FIGS. 2 through 5 without having the blank flipped or inverted.

Adhesive lines 27 and 34 are applied to the frame rear panel 24. The frame front panel 20 can be automatically folded over onto the frame rear panel 24, where adhesive lines 27, 34 bond the panels together. Typically, the product can be shipped to retail distribution or consumers in this configuration.

To prepare the present invention for mailing, a user inserts a picture into the opening between the front and rear frame panels 20, 24. The frame 4 can then be folded over onto the rear mailer panel 28.

Figure 9:
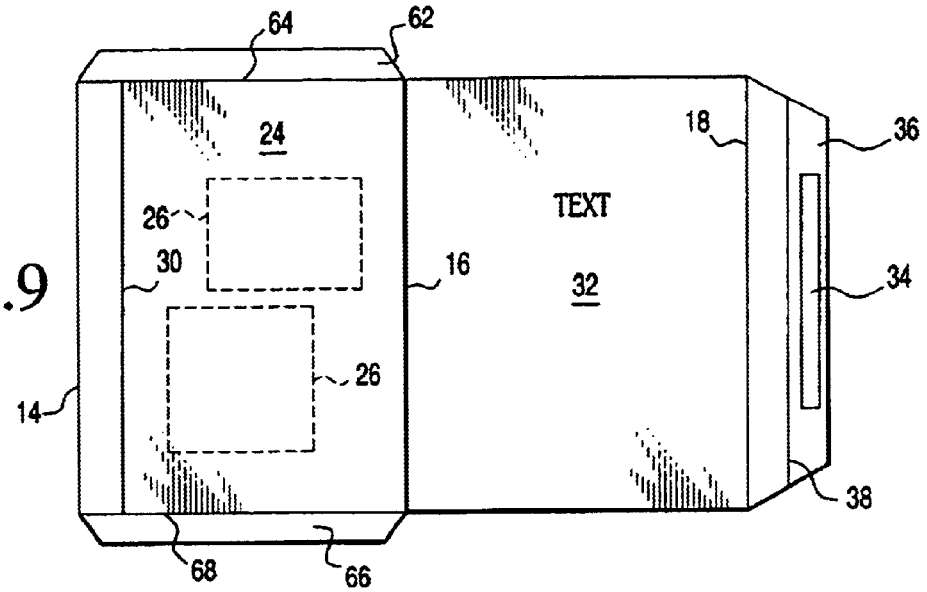
FIG. 9 is a top plan view of the blank of FIG. 8 showing partial enclosure of the frame in the mailer, with the retaining flaps in an unfolded position.

Referring to FIG. 9, the frame 4 has been folded along the fold line 14 to overlay the mailer rear panel 28, with the retaining flaps 62, 66 shown in an unfolded position.

Figure 10:
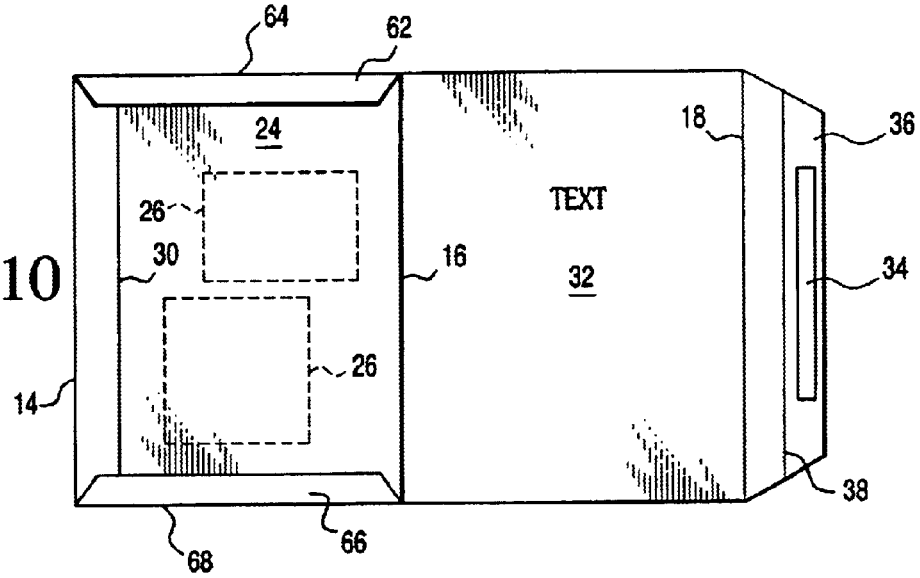
FIG. 10 is a top plan view of the blank of FIG. 9, showing partial enclosure of the frame in the mailer with the retaining flaps overlaying a portion of the frame.
Figure 11:
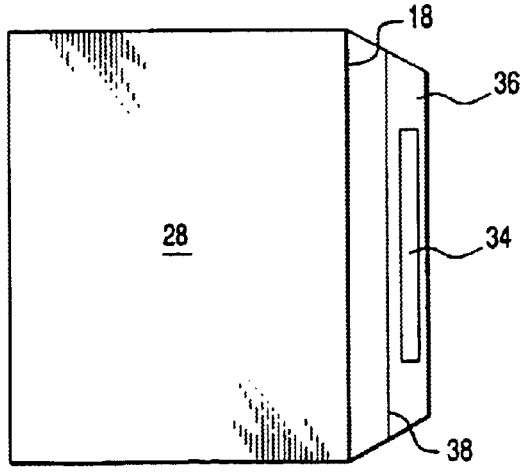
FIG. 11 is a top plan view of the blank of FIG. 10 showing an unsealed folded mailer.

As seen in FIG. 10, the retaining flaps 62, 66 have been folded along the respective fold lines to overlay a portion of the frame rear panel 24. As the retaining flaps 62, 66 are non-adhesive, the retaining flaps are initially retained in the folded position by the corresponding fold line 64, 68.

The frame 4 and the mailer rear panel 28 can then be folded over onto the mailer front panel 32 as shown on FIG. 4. The front and the rear frame panels are protected by the mailer front and rear panels. That is, the panels form a stack in the order of mailer front panel 32, frame rear panel 24, frame front panel 20 and the mailer rear panel 28. In the configuration of FIGS. 7–11, the folded configuration provides an order the mailer front panel 32, the retaining flaps 62, 66, the frame rear panel 24, the frame front panel 20, and the mailer rear panel 28. The retaining flaps 62, 66 are sized, and the material of the blank 10 is selected to substantially preclude the retaining flaps from passing from the folded location intermediate frame rear panel 24 and the mailer front panel 32. Finally, the closure flap 36 is folded over and sealed to the second side of the mailer rear panel 28.

The recipient of the mailer can open the mailer by pulling the zip strip 34. The mailer 6 can be unfolded along the second and third fold lines. For the blank of FIGS. 7–11, the retaining flaps 62, 66 are folded along the corresponding fold lines to expose the frame rear panel 24. The recipient can then read or access any material attached to the first side of the mailer front and rear panels 32, 28. The frame 4 is detached from the mailer along the separation line 30, with the newly formed edge being behind, hidden by the frame front panel 20. The easels are formed folding out from the easel forming cuts 26 and the framed picture can be self-supporting on a table or mantel.

The present construction can be used with any relatively thin substrate such as photographs. However, drawings and sketches, invitations, or awards can be employed with the combined frame and mailer.

The combined frame and mailer provides an integral one piece frame and mailer, wherein a photograph can be retained and located within the frame. Text, messages or inserts can be connected to the mailer, and the integral mailer can then be folded and sealed about the frame 4 to protect the front and rear of the frame during the transportation process. As the front and mailer panels have a foot print at least as large as the front frame and rear frame panels, the frame is protected. The sealed device can be readily opened by severing the closure flap without damaging the mailer or the frame. Subsequently, the mailer can be separated from the frame along an effectively hidden separation line.

While preferred embodiments of the invention have been shown and described with particularity, it will be appreciated that various changes and modifications may suggest themselves to one having ordinary skill in the art upon being apprised of the present invention. It is intended to encompass all such changes and modifications as fall within the scope and spirit of the appended claims.

What is claimed is:

1. An integral mailer and frame, comprising:

a) a frame front panel having an aperture therein;

b) a frame rear panel foldably connected to the frame front panel along a first fold line and adhered to the frame front panel along opposite side portions to form a picture receiving pocket therebetween, the fame rear panel including easel forming cuts;

c) a mailer rear panel foldably connected to the frame rear panel along a second fold line;

d) a mailer front panel foldably connected to the mailer rear panel along a third fold line;

e) a closure flap foldably connected to the mailer front panel along a closure fold line;

f) the fold lines being parallel and the mailer panels each having a footprint at least as large as that of the frame front and rear panels; and g) the panels and the fold lines being arranged to permit folding the panels about the fold lines to lay the panels one against another in an ordered overlaying configuration comprising, in order, the mailer front panel, the frame rear panel, the frame front panel and the mailer rear panel such that i) both the front and rear frame panels are protected by disposition between the mailer front and rear panels and ii) the easel forming cuts of the rear panel are protected by disposition between the frame front panel and the mailer front panel.

2. The integral mailer and frame of claim 1, wherein the mailer rear panel and the mailer front panel are each contiguous pieces.

3. A blank for forming an integral mailer and frame comprising:

a) a frame front panel having a picture display aperture;

b) a frame rear panel connected to the frame front panel along a first fold line, the frame rear panel including a separation line running parallel to the first fold and easel forming cuts disposed between the first fold line and the separation line;

c) a mailer rear panel connected to the frame rear panel along a second fold line;

d) a mailer front panel connected to the mailer rear panel along a third fold line, each of the mailer panels having a footprint at least as large as the frame panels;

e) a closure flap connected to the mailer front panel along a fourth fold line;

f) the first, second, third and fourth fold lines being sequentially arranged and substantially parallel one to another;

g) the frame and mailer front and rear panels being foldable along the first, second and third fold lines to dispose the panels in an overlaying configuration one against another; and h) in the overlying configuration, the frame panels are disposed between the mailer panels such that both the easel forming cuts and the separation line are disposed between the frame front panel and the mailer front panel.

4. A blank as in claim 3 wherein one of the frame front and rear panels includes an adhesive strip at opposite side portions to adhere the frame panels together and from a picture receiving pocket therebetween.

* * * * *